US005666921A

United States Patent [19]

Collingborn

[11] Patent Number: 5,666,921

[45] Date of Patent: Sep. 16, 1997

[54] FUEL SUPPLY APPARATUS

[75] Inventor: Peter Alban George Collingborn, Kent, United Kingdom

[73] Assignee: Lucas Industry Public Limited Company, England

[21] Appl. No.: 644,516

[22] Filed: May 10, 1996

[30] Foreign Application Priority Data

May 12, 1995 [GB] United Kingdom ..... 9509609

[51] Int. Cl.[6] ..... F02M 37/04

[52] U.S. Cl. ..... 123/450; 417/462

[58] Field of Search ..... 123/450, 447, 123/500, 501; 417/462

[56] References Cited

U.S. PATENT DOCUMENTS

| | | | |
|---|---|---|---|
| 3,557,764 | 1/1971 | Knight et al. | 123/139 |
| 4,393,844 | 7/1983 | Skinner | 417/462 |
| 4,517,946 | 5/1985 | Takano | 123/450 |
| 4,530,331 | 7/1985 | Gibson | 123/450 |
| 4,554,901 | 11/1985 | Gibson et al. | 123/450 |
| 4,711,618 | 12/1987 | Abinett | 417/462 |
| 4,879,984 | 11/1989 | Rembold | 123/450 |
| 5,431,142 | 7/1995 | Bonse | 123/450 |
| 5,564,394 | 10/1996 | Wood | 123/450 |

*Primary Examiner*—Carl S. Miller
*Attorney, Agent, or Firm*—Cesari and McKenna

[57] ABSTRACT

A fuel supply apparatus is disclosed which includes a distributor comprising a distributor member rotatable within a bore provided in a sleeve. The sleeve is provided with a plurality of feed ports and a plurality of delivery ports, fewer feed ports being provided than delivery ports. The distributor member is provided with a delivery passage registrable with the delivery ports, in turn, and a plurality of feed passages registrable with the feed ports. The feed and delivery passages communicate with one another. The feed and delivery passages are located so that when the delivery passage registers with one of the delivery ports, one or more of the feed passages register with respective feed ports.

11 Claims, 4 Drawing Sheets

74
70
76
78
72
22A
68
18A
28
66
22
64
56
58
62
24
26
34
60
14
16
20A
18
12
32
20
30
10

FUEL SUPPLY APPARATUS

This invention relates to a fuel supply apparatus suitable for use in the supply of fuel to the cylinders of an internal combustion engine, and to a distributor for use in such an apparatus.

In order to permit fuel to be delivered to the cylinders of an engine at high pressure, in one type of fuel supply apparatus fuel is supplied under pressure to an accumulator, for example using a rotary fuel pump. Fuel is supplied from the accumulator through a valve to a distributor which is used to distribute the fuel to the cylinders of the engine, in turn. After delivery of a predetermined quantity of fuel, the valve is actuated to terminate delivery and to permit the pressure in the line communicating with the cylinder injection nozzle to fall by connecting the line to a suitable drain.

After the pressure in the line has been permitted to fall, the distributor connects a different one of the injection nozzles to the valve and the supply sequence is repeated.

According to the present invention there is provided a distributor for use in a fuel supply apparatus, the distributor comprising a distributor member rotatable within a sleeve, the sleeve being provided with a plurality of delivery ports and a plurality of feed ports, the number of feed ports being smaller than the number of delivery ports, the distributor member being provided with a delivery passage registrable with the delivery ports, in turn, on rotation of the distributor member, and a plurality of feed passages registrable with the feed ports, in turn, on rotation of the distributor member, the delivery and feed passages communicating with one another and being arranged such that when the delivery passage registers with one of the delivery ports, at least one of the feed passages registers with a respective feed port.

Where the sleeve is provided with m feed ports and n delivery ports, the distributor member is preferably provided with x feed passages, where:

$$x=\frac{n}{m}$$

Such an arrangement results in one of the feed passages registering with one of the feed ports each time the delivery passage registers with one of the delivery ports.

The invention further relates to a fuel supply apparatus comprising an accumulator arranged to be supplied with fuel at high pressure, a valve arranged to control delivery of fuel from the accumulator, and a distributor of the type defined hereinbefore arranged to distribute the fuel to the cylinders of an associated engine, in turn.

The invention will further be described, by way of example, with reference to the accompanying drawings, in which.

Figure 1:
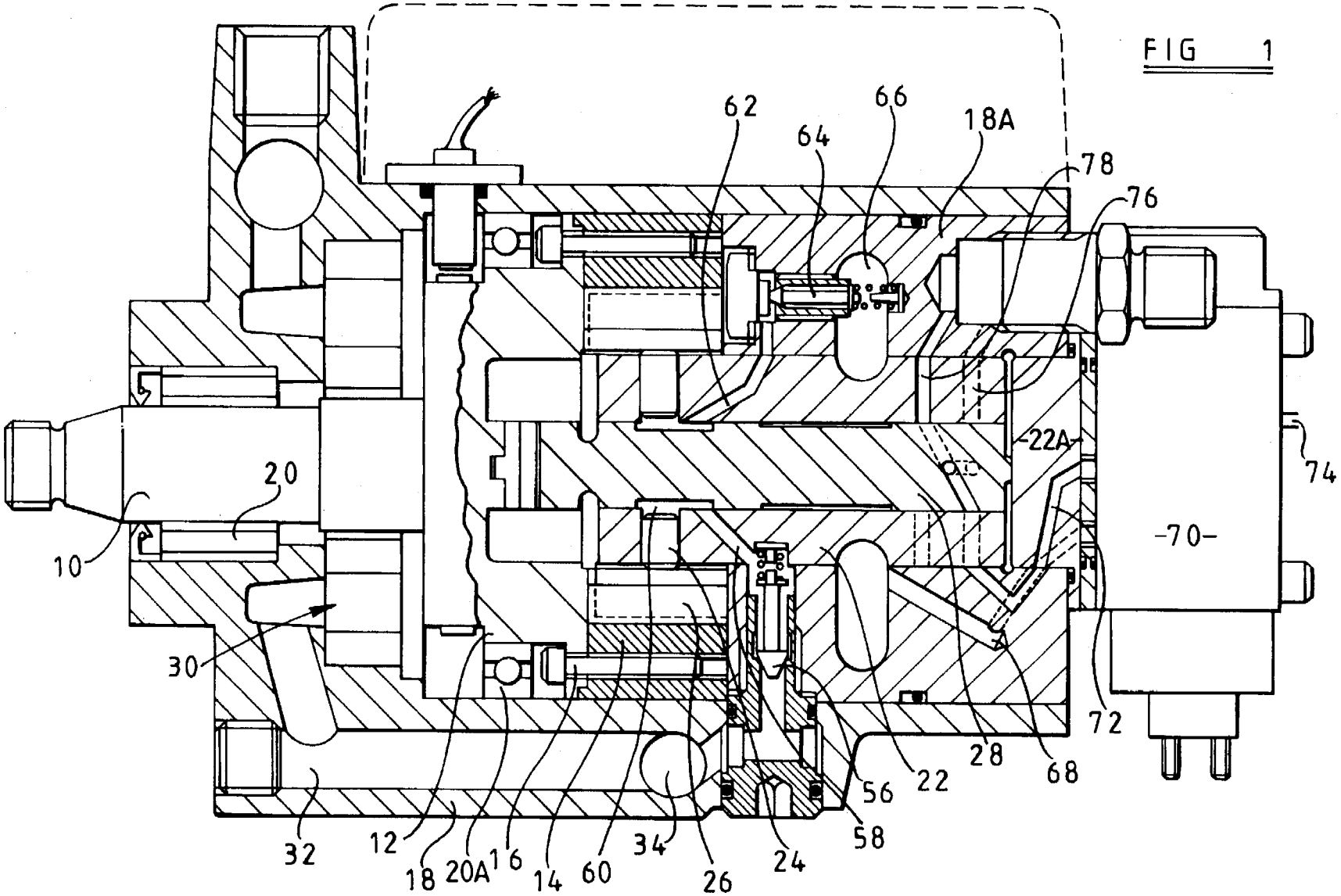
FIG. 1 is a diagrammatic cross-sectional view of a fuel supply apparatus.

The fuel supply apparatus illustrated in FIG. 1 is for supplying fuel to a four cylinder engine and comprises a shaft 10 arranged to be driven at a speed related to engine speed, the shaft 10 including an enlarged region 12 to which a cam ring 14 is secured by means of bolts 16. The shaft together with the enlarged region 12 is rotatably supported within a multi-part housing 18 by means of bearings 20, 20A.

A cylindrical steel sleeve 22 is provided within the housing 18, the sleeve 22 being an interference fit within a substantially cylindrical recess provided in a further steel sleeve 18A which forms part of the housing 18. The sleeve 22 includes a region extending within the cam ring 14 which includes a pair of radially extending bores within which plungers 24 are reciprocable. The outer end of each plunger 24 engages a shoe and roller arrangement 26 the roller of which is arranged to engage the inner surface of the cam ring 14, that surface of the cam ring 14 being provided with a plurality of spaced cam lobes. The shoe and roller arrangements 26 are received within slots (denoted by dashed lines in, and out of the plane of, FIG. 1) provided in a reduced diameter extension of the sleeve 18A which extends within the cam ring 14 in order to prevent angular movement of the shoe and roller arrangements 26 and to avoid the application of the high torque across the interference fit between the sleeve 18A and the sleeve 22 which may otherwise occur.

The sleeve 22 is provided with an axially extending through bore within which a cylindrical distributor member 28 is rotatable, the distributor member 28 being keyed to the shaft 10 so as to rotate at the same speed as the shaft 10.

The housing 18 further houses a vane pump 30 arranged to be driven by the drive shaft 10. The vane pump 30 is arranged to receive fuel from a suitable fuel reservoir, and to deliver fuel to a passage 32 which communicates with the inlet of a metering valve 34.

Figure 2:
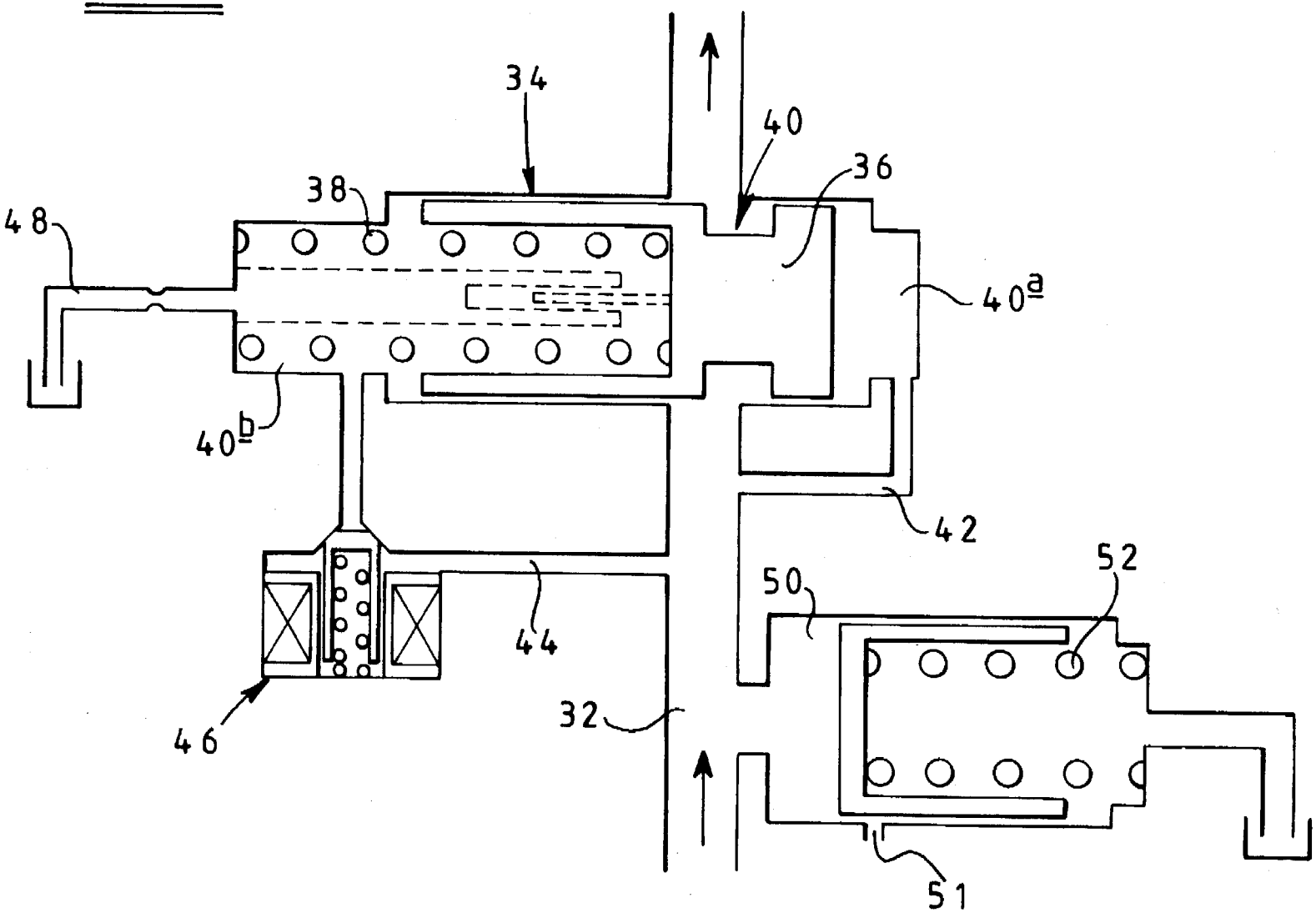
FIG. 2 is a diagrammatic view of the metering valve of the apparatus of FIG. 1.
Figure 3:
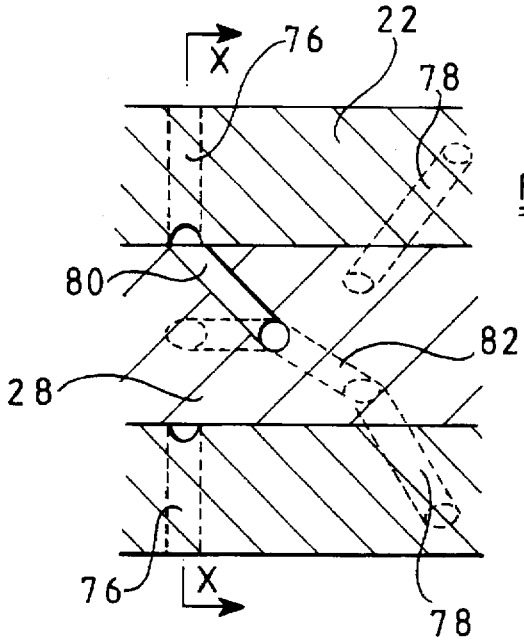
FIG. 3 is an enlarged diagrammatic view of part of the apparatus of FIG. 1.

As illustrated in FIG. 2, the metering valve 34 comprises a valve element 36 which is reciprocable within a chamber 40 provided in the housing 18, the chamber 40 communicating with the passage 32. The valve element 36 divides the chamber 40 into two separate sub-chambers 40*a*, 40*b*. The sub-chamber 40*a* communicates directly with the passage 32 by means of a passage 42 provided in the housing 18. The sub-chamber 40*b* also communicates with the passage 32 on the inlet side of the chamber 40 by means of a passage 44, flow along the passage 44 being controlled by a solenoid operated control valve 46. The valve element 36 is biased by means of a spring 38 towards a position in which the sub-chamber 40*a* is of minimum volume.

The valve element 36 is shaped so as to include a region defining a flow passage which in a first position of the valve element permits flow along the passage 32 from one side of the chamber 40 to the other, and in a second position of the valve element 36 in the chamber 40, obturates such flow. As illustrated in FIG. 2, the position in which flow is permitted along the passage 32 is when the valve element 36 is in its left most position, flow being prevented when the valve element 36 is moved to the right so that the sub-chamber 40*a* is of minimum volume.

A passage 48 communicates with the sub-chamber 40*b* the passage 48 including a restricted region so as to restrict flow along the passage 48. The passage 48 communicates with a suitable drain.

In use, when the control valve 46 is open, the pressure of the fuel applied to both the sub-chambers 40*a*, 40*b* is substantially equal, the presence of the spring 38 pushing the valve element 36 towards the right as shown in FIG. 2 thus closing the passage 32. On actuating the control valve 46 to close the valve 46, further fuel is not permitted to enter the sub-chamber 40*b*, and since fuel is permitted to leak from the chamber 40*b* through the restricted passage 48, the pressure of fuel therein will gradually reduce, the pressure of fuel within the sub-chamber 40*a* remaining at its previous value. It will be recognised that in these circumstances the valve element 36 tends to move towards the left as shown in FIG. 2, permitting fuel to flow along the passage 32.

An accumulator 50 communicates with the passage 32 such that when the metering valve 34 is closed, the volume of the accumulator can increase against the action of the spring 52 provided therein in order to prevent the pressure of the fuel within the passage 32 increasing excessively. The accumulator 50 further includes a pressure relief port 54 arranged to open when the volume of the accumulator 50 reaches a predetermined value, the pressure relief port 54 acting further to prevent excessive pressure within the passage 32.

As the valve element 36 moves to open the metering valve 34 reestablishing flow along the passage 32, fuel flows out of the accumulator 50 thus minimizing any reduction in the pressure of fuel within the passage 32. The flow of fuel out of the accumulator 50 further permits the instantaneous rate of fuel flow through the valve 34 to be greater than the output rate of the vane pump 30. These two effects permit an increase in the quantity of fuel able to be delivered to the chamber 60 (described hereinafter) in each pumping cycle permitting the fuel supply apparatus to supply sufficient fuel as required, for example, when the associated engine is operating at high load and speed.

As illustrated in FIG. 1, the fuel supplied from the metering valve 34 passes through a non-return valve 56 housed in the sleeve 18A and a port 58 provided in the sleeve 22 to an annular chamber 60 formed by a groove in the outer surface of the distributor member 28, the chamber 60 communicating with the inner ends of the bores in the sleeve 22 housing the plungers 24.

In use, the rate of fuel flow through the non-return valve 56 is intermittent, hence the rate of flow of fuel through the metering valve 34 varies substantially continuously.

The chamber 60 further communicates through a passage 62 and non-return valve 64 with an annular accumulator chamber 66 which is formed partly in the sleeve 18A and partly in the sleeve 22.

In use, on rotation of the drive shaft 10, a point will be reached at which the rollers of the roller and shoe arrangements 26 move over the crests of the cam lobes of the cam ring 14. At this point the pressure of fuel supplied by the metering valve 34 through the non-return valve 36 will be sufficient to push the plungers 24 and the shoe and roller arrangements 26 radially outward, increasing the volume of the chamber 60. Continued rotation of the drive shaft 10 will result in rotation of the cam ring 14 such that the rollers of the shoe and roller arrangements 26 engage with the leading flanks of the cam lobes provided on the cam ring 14, the engagement resulting in the plungers 24 being pushed inwards to pressurize the fuel within the radially extending bores and the chamber 60. The presence of the non-return valve 56 substantially prevents fuel from the chamber 60 returning to the metering valve 34, and instead fuel from the chamber 60 is supplied to the accumulator chamber 66 through the passage 62 and non-return valve 64 in order to pressurize the fuel in the accumulator chamber. Continued rotation of the drive shaft 10 will result in the rollers moving over the crests of the cam lobes, and hence in further fuel being supplied to the chamber 60 from the metering valve 34 as described above. The operation of the control valve 46 is under the control of an electronic control system which receives a signal fro a pressure transducer responsive to the fuel pressure in the accumulator chamber 66.

The end of the sleeve 18A remote from the drive shaft is closed by a flanged plug 22A which is a sealing fit within the sleeve. The plug serves as a mounting for a two position three way valve 70. The valve has a common port which is connected to a common passage 72 partly formed in the plug and continuing in the sleeve 18A. One of the other ports of the valve is connected by a passage in the plug and sleeve with a passage 68 connected to the accumulator chamber 66, and the other of said other ports of the valve is connected to a drain passage 74.

Figure 4:
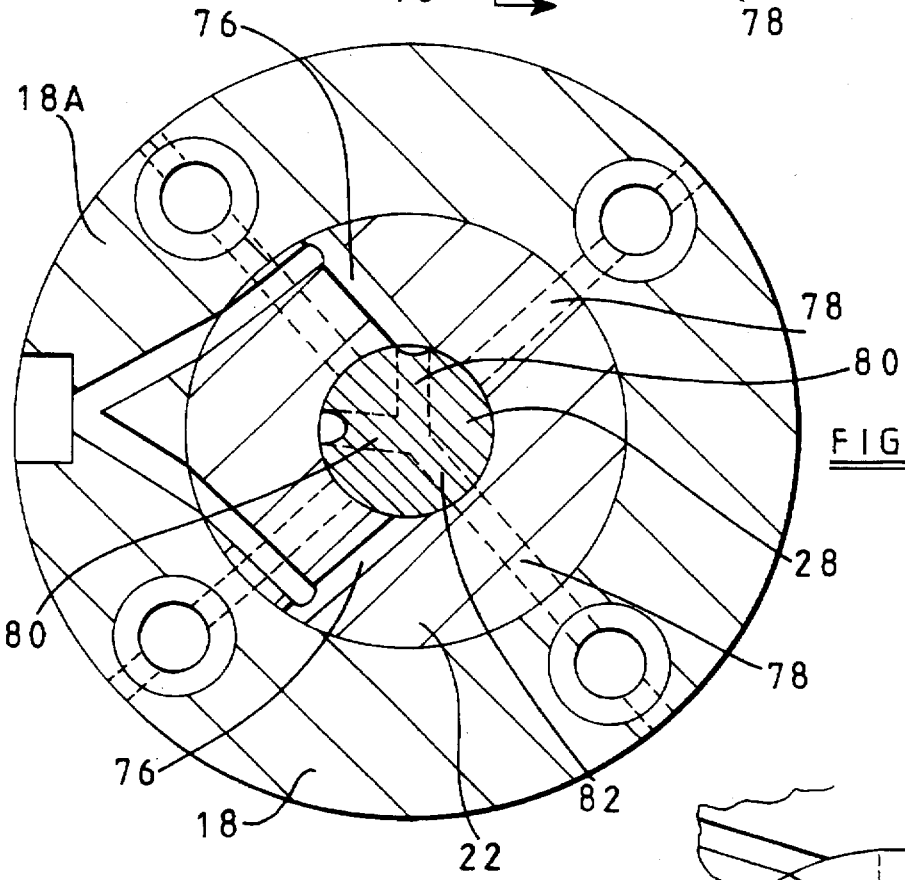
FIG. 4 is a cross-sectional view along the line X—X of FIG. 3.

The common passage 72 is arranged to communicate with a pair of feed ports 76 provided in the sleeve 22. As illustrated in FIG. 4, the feed ports 76 are arranged to communicate with the bore within which the distributor member 28 is rotatable at a pair of diametrically opposed locations. The sleeve 22 is further provided with four equi-angularly spaced delivery ports 78 which are axially spaced from and are out of alignment with the feed ports 76. Each of the delivery ports 78 communicates with the outlet connections which in use communicate with the injection nozzles respectively of an associated engine.

The distributor member 28 is provided with a pair of feed passages 80 and a delivery passage 82, the feed passages 80 and delivery passage 82 communicating with one another. The feed passages 80 are arranged to register with the feed ports 76 provided in the sleeve 22, and outer ends of the feed passages 80 subtend an angle of 90° with respect to one another. The delivery passage 82 is arranged to register with the delivery ports 78 provided in the sleeve 22 as the distributor member 28 rotates with respect to the sleeve 22. As illustrated in the view in FIG. 4, the delivery passage 82 subtends an angle of 135° with respect to each of the feed passages 80. It must be recognised, however, that the positions of the passages 80, 82 illustrated in FIG. 4 are merely diagrammatic, the passages not being in the plane illustrated in FIG. 4.

In use, in order to deliver fuel to the injection nozzle of the desired cylinder of the engine, the valve 70 is actuated so as to permit communication between the accumulator chamber 66 and the common passage 72. At this time, for example as shown in FIG. 4, one of the feed passages 80 of the distributor member 28 is aligned with one of the feed ports 76, and the delivery passage 82 is aligned with one of the delivery ports 78 so that fuel from the accumulator 66 will be supplied through the valve 70 to the respective injection nozzle. After delivery of the predetermined amount of fuel, the valve 70 is actuated so as to break the communication between the common passage 72 and the accumulator chamber 66, and instead the common passage 72 is connected to the passage 74 whereby the pressure in the line to the injection nozzle is permitted to fall, fuel escaping to the drain through the passage 74.

It will be appreciated that during both the delivery of fuel and subsequent reduction in the line pressure, the distributor member 28 is rotating with respect to the sleeve 22, and hence the delivery and feed passages and the delivery and feed ports have to be of an appropriate size.

After the line pressure has fallen, rotation of the distributor member 28 with respect to the sleeve 22 will result in the communication between the delivery port 78 and delivery passage 82 being broken, and also in the breaking of the communication between the appropriate ones of the feed passages 80 and feed ports 76.

Further rotation of the distributor member 28 with respect to the sleeve will result in the delivery passage 82 registering with another of the delivery ports 78 and also with one of the feed passages 80 aligning with one of the feed ports 76. After such registration has occurred, the valve 70 is actuated once more to permit fuel from the accumulator chamber 66 to be delivered to the next injection nozzle of the associated engine. As described above, such a delivery is followed by connecting the delivery line to drain to permit the pressure in the delivery line to be reduced.

In the embodiment illustrated in FIG. 4, each of the feed ports 76 is formed by two drillings in the sleeve 22A. In the modification illustrated in FIG. 5, one of the drillings is replaced by a recess provided in the outer wall of the sleeve 22, the other of the drillings communicating with the recess, thus simplifying production of the sleeve 22.

Figure 5:
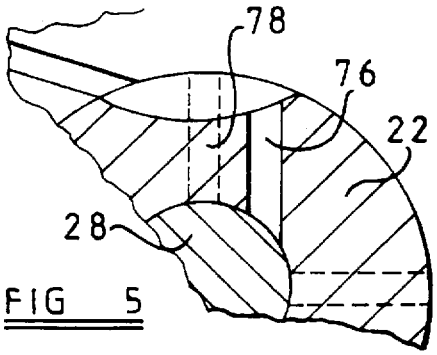
FIG. 5 is a view similar to FIG. 4 of a modified embodiment.

In both the embodiment illustrated in FIGS. 1 to 4 and in the modification illustrated in FIG. 5, the path length from the valve 70 to both of the inlet ports 76 is equal. The provision of equal path lengths is advantageous in that substantially the same length of time and quantity of fuel is required to pressurize the paths. The provision of the equal path lengths therefore results in the quantity of fuel delivered to the injection nozzle being substantially equal regardless as to which of the paths is used.

It will also be noted that the direction of movement of fuel within the distributor member 28 is only changed by a relatively small angle in this embodiment, a number of prior art devices requiring the fuel direction to be changed by a relatively large angle and hence result in the generation of a relatively large amount of heat. The relatively small change in direction of fuel movement in the distributor member 28 of this embodiment reduces the amount of heat generated, and hence reduces the risk of thermal expansion of the distributor member 28 and subsequent seizure.

Figure 6:
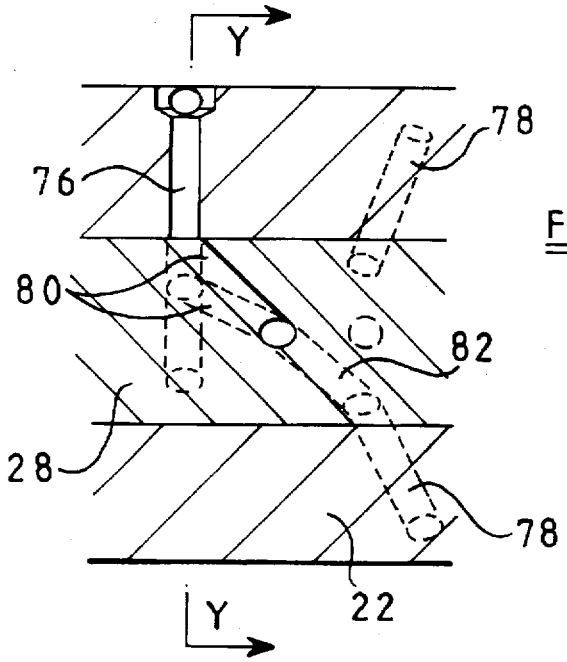
FIG. 6 is a view similar to FIG. 3 of second modification.
Figure 7:
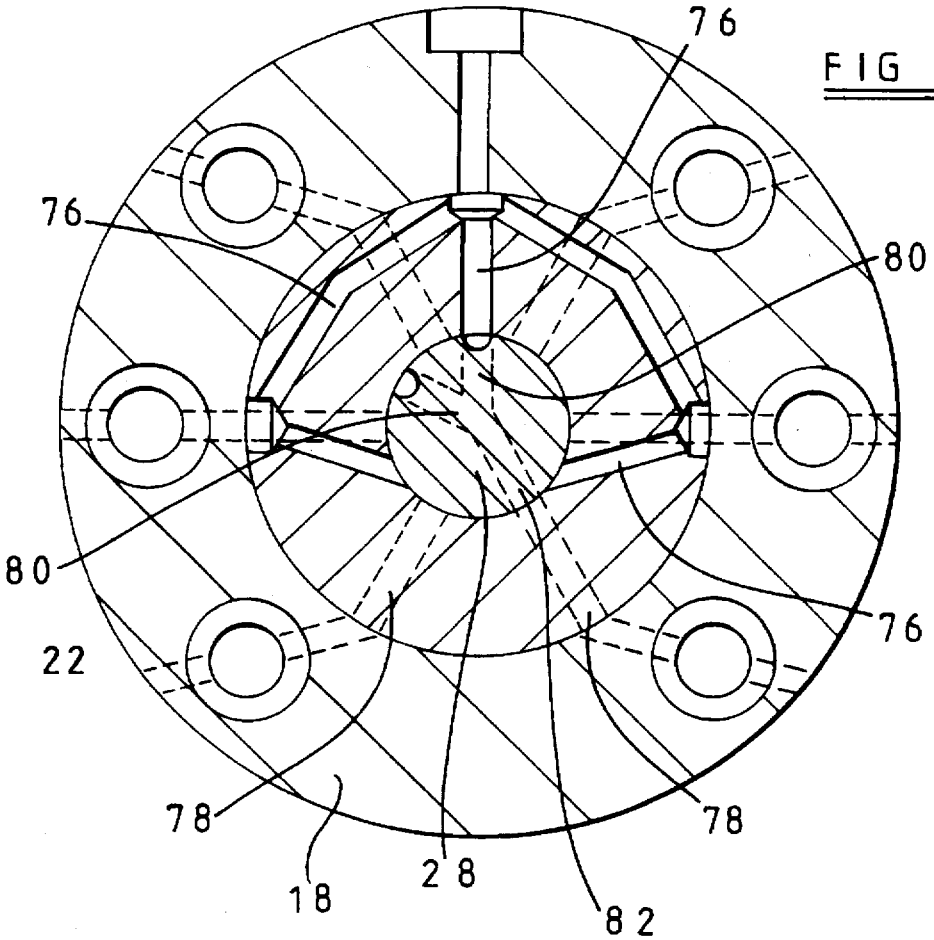
FIG. 7 is a cross-sectional view along the line Y—Y of FIG. 6.

FIGS. 6 and 7 relate to a modification of the apparatus illustrated in FIG. 1 to permit use thereof with an engine having six cylinders rather than four. In this embodiment, the pair of feed ports 76 is replaced by three equi-angularly spaced feed ports 76, and the four equi-angularly spaced delivery ports 78 illustrated in FIG. 4 are replaced by six equi-angularly spaced delivery ports 78. As a result of the change in the number of feed and delivery ports 76, 78, the feed passages 80 provided in the distributor member 28 are spaced apart from one another by an angle of 60° rather than 90° as in the embodiment illustrated in FIG. 4. The delivery passage 82 is therefore spaced from each of the feed passages 80 by an angle of 150°. Operation of this device is as described with reference to the previously described embodiment, and will not be described in further detail.

It will be noted that in the modification illustrated in FIGS. 6 and 7, the path lengths from the valve to each of the feed ports 76 are not equal. However the path lengths are of sufficiently similar length that the variation in the length of time required to pressurized the paths does not result in a significant variation in the quantity of fuel delivered by the fuel supply apparatus.

In some known devices, a single feed port 76 is used, the port communicating with an annular recess formed on the distributor member. By using a plurality of feed ports 76 and an associated plurality of feed passages 80 in the distributor member 28, the provision of such an annulus is not required and hence the leakage which tends to occur between the sleeve 22 and distributor member 28 in such devices can be reduced. Similarly, by using divided feed ports in the sleeves 18A, 22, the provision of an annulus or part annulus between the two sleeves can be avoided.

I claim:

1. A distributor for use in a fuel supply apparatus, the distributor comprising a distributor member rotatable within a bore provided in a sleeve, the sleeve being provided with a plurality of delivery ports and a plurality of feed ports, the number of feed ports being smaller than the number of delivery ports, the distributor member being provided with a delivery passage registrable with the delivery ports, in turn, on rotation of the distributor member, and a plurality of feed passages registrable with the feed ports, in turn, on rotation of the distributor member, the delivery and feed passages communicating with one another and being arranged such that when the delivery passage registers with one of the delivery ports, at least one of the feed passages registers with a respective feed port.

2. A distributor as claimed in claim 1, wherein the feed passages and feed ports are located so that when the delivery passage registers with one of the delivery ports, a single feed passage registers with a respective feed port.

3. A distributor as claimed in claim 1, wherein the feed and delivery ports are axially spaced from one another.

4. A distributor as claimed in claim 1, wherein the feed and delivery ports are angularly spaced from one another.

5. A distributor as claimed in claim 1, wherein the sleeve is provided with four delivery ports and two feed ports, the distributor member being provided with two feed passages.

6. A distributor as claimed in claim 5, wherein the feed passages are perpendicular to one another, the feed ports communicating with diametrically opposed parts of the bore.

7. A distributor as claimed in claim 1, wherein the sleeve is provided with three feed ports and six delivery ports, the distributor member being provided with two feed passages.

8. A distributor as claimed in claim 7, wherein the feed ports are equiangularly spaced around the bore, the feed passages subtending an angle of 60° with one another.

9. A distributor as claimed in claim 1, wherein at least one of the feed ports comprises a plurality of interconnected drillings.

10. A distributor as claimed in claim 1, wherein at least one of the feed ports comprises a drilling communicating with a recess provided on the periphery of the sleeve.

11. A fuel supply apparatus comprising an accumulator arranged to be charged with fuel, a valve arranged to control fuel delivery from the accumulator, and a distributor as claimed in claim 1, the valve controlling fuel delivery to the feed ports of the distributor.

* * * * *